United States Patent [19]

Hayashi

[11] Patent Number: 4,554,891

[45] Date of Patent: Nov. 26, 1985

[54] COOLANT LEVEL CONTROL ARRANGEMENT FOR INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 593,289

[22] Filed: Mar. 26, 1984

[30] Foreign Application Priority Data

Mar. 31, 1983 [JP] Japan ..... 58-53786

[51] Int. Cl.[4] ..... F01P 3/22

[52] U.S. Cl. ..... 123/41.21; 123/41.44; 123/198 D; 123/41.15

[58] Field of Search ..... 123/41.11, 41.12, 41.15, 123/41.2, 41.21, 41.24, 41.27, 41.44, 41.51–41.54, 198 R, 198 D, 41.01, 41.02, 41.22, 41.23, 41.25, 41.26; 340/59; 73/304 R

[56] References Cited

U.S. PATENT DOCUMENTS

| | | | |
|---|---|---|---|
| 1,376,086 | 4/1921 | Fairman | 123/41.2 |
| 1,787,562 | 1/1931 | Barlow | 123/41.44 |
| 1,792,520 | 2/1931 | Weinhardt | 123/41.44 |
| 1,907,845 | 5/1933 | Macrae et al. | 123/41.15 |
| 3,694,804 | 9/1972 | Hill | 123/41.15 |
| 3,763,836 | 10/1973 | Guehr | 123/41.15 |
| 3,832,982 | 9/1974 | Guehr | 123/41.15 |
| 3,845,464 | 10/1974 | Engel | 73/304 R |
| 3,939,470 | 2/1976 | Arai et al. | 340/59 |
| 3,983,859 | 10/1976 | Pritchard | 123/41.15 |
| 4,277,773 | 7/1981 | Blatnik | 73/304 R |
| 4,367,699 | 1/1983 | Evans | 123/41.49 |

FOREIGN PATENT DOCUMENTS

| | | |
|---|---|---|
| 0041853 | 12/1981 | European Pat. Off. . |
| 0059423 | 8/1982 | European Pat. Off. . |
| 644135 | 10/1928 | France . |
| 2217531 | 6/1974 | France . |

*Primary Examiner*—William A. Cuchlinski, Jr.
*Attorney, Agent, or Firm*—Schwartz, Jeffery, Schwaab, Mack, Blumenthal & Evans

[57] ABSTRACT

The level of coolant in the coolant jacket of an "evaporation cooled" engine (wherein the coolant is boiled off in place of being forcefully circulated) is detected by a plurality of level sensors so that even though the attitude of the coolant level changes due to a change in orientation of the engine or the like, as long as one of the sensors is immersed in the coolant, the pump which recirculates condensed coolant from a radiator is not energized. An additional low level sensor is used to lower the level of the coolant to an predetermined low level to promote rapid engine warm-up during cold engine starts.

6 Claims, 1 Drawing Figure

COOLANT LEVEL CONTROL ARRANGEMENT FOR INTERNAL COMBUSTION ENGINE

BACKGROUND OF THE INVENTION

1. Field of the Invention

The present invention relates generally to an internal combustion engine of the type wherein coolant is "boiled off" to make use of the latent heat of evaporation of the coolant and the coolant vapor used as a heat transfer medium, and more specifically to an improved coolant level control arrangement therefor.

2. Description of the Prior Art

In currently used "water cooled" internal combustion engines, the engine coolant (liquid) is forcefully circulated by a water pump through a circuit including the engine coolant jacket and a radiator (usually fan cooled). However, in this type of system a drawback is encountered in that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this a flow rate of 167 l/min (viz., $4000-60\times\frac{1}{4}$) must be produced by the water pump. This of course undesirably consumes a number of horsepower.

In order to overcome this problem it has been proposed to "boil" the coolant and use the vaporized coolant as a heat transfer medium thus taking advantage of the latent heat of evaporation of the coolant. Examples of such arrangements are found in U.S. Pat. No. 1,376,086 issued on Apr. 25, 1921 in the name of Fairman and in European Patent Application Publication No. 0059423 published on Sept. 8, 1982.

However, with such arrangements a problem has been encountered that it is difficult to maintain an adequate level of coolant in the coolant jacket and to avoid either overfilling or underfilling of same especially in automotive applications wherein the attitude of the coolant level changes with change in orientation of the engine and/or vehicle and/or under the influence of centrifugal force when the vehicle traverses a corner or the like. A further problem has been encountered in that upon boiling of the coolant extraordinarily large gas bubbles are sometimes produced which displace the coolant from a particular portion of the coolant jacket permitting the formation of "hot spots" therein. These so called "hot spots" due to their inherent elevated temperature tend to promote the formation of further large gas bubbles which subsequently induces a localized "dry out" within the coolant chamber. This of course leads to knocking and/or thermal damage (e.g. piston seizure).

SUMMARY OF THE INVENTION

It is a primary object of the present invention to provide a coolant level control arrangement for an internal combustion engine of the type wherein the coolant is "boiled off" which obviates overfilling and underfilling of the coolant jacket and which maintains a level which obviates the formation of "hot spots" and "dry outs".

It is a secondary object of the present invention to provide a level control arrangement which permits the amount of coolant in the jacket to be temporarily reduced to predetermined low level during cold engine starts to promote rapid engine warm-up.

In brief, these objects are fullfilled by an embodiment of the invention wherein the coolant level is detected by a plurality of level sensors so that even though the attitude of the coolant surface changes due to a change in orientation of the engine or the like, as long as one of the sensors is immersed in the coolant, the pump which recirculates condensed coolant from a radiator is not energized. An additional low level sensor is used to lower the level of the coolant to a predetermined low level to promote rapid engine warm-up during cold engine starts.

More specifically, the present invention in its broadest sense takes the form of an internal combustion engine which features a coolant jacket into which coolant is introduced in liquid form and discharged in gaseous form, a pump for recirculating liquid coolant from a radiator into which gaseous coolant from the coolant jacket is introduced and condensed to a liquid form, to said coolant jacket, a level sensor disposed in the coolant jacket for detecting the presence of liquid coolant at a predetermined level therein, and a control circuit responsive to the level sensor for energizing the pump when the sensor indicates the level is below the predetermined one.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
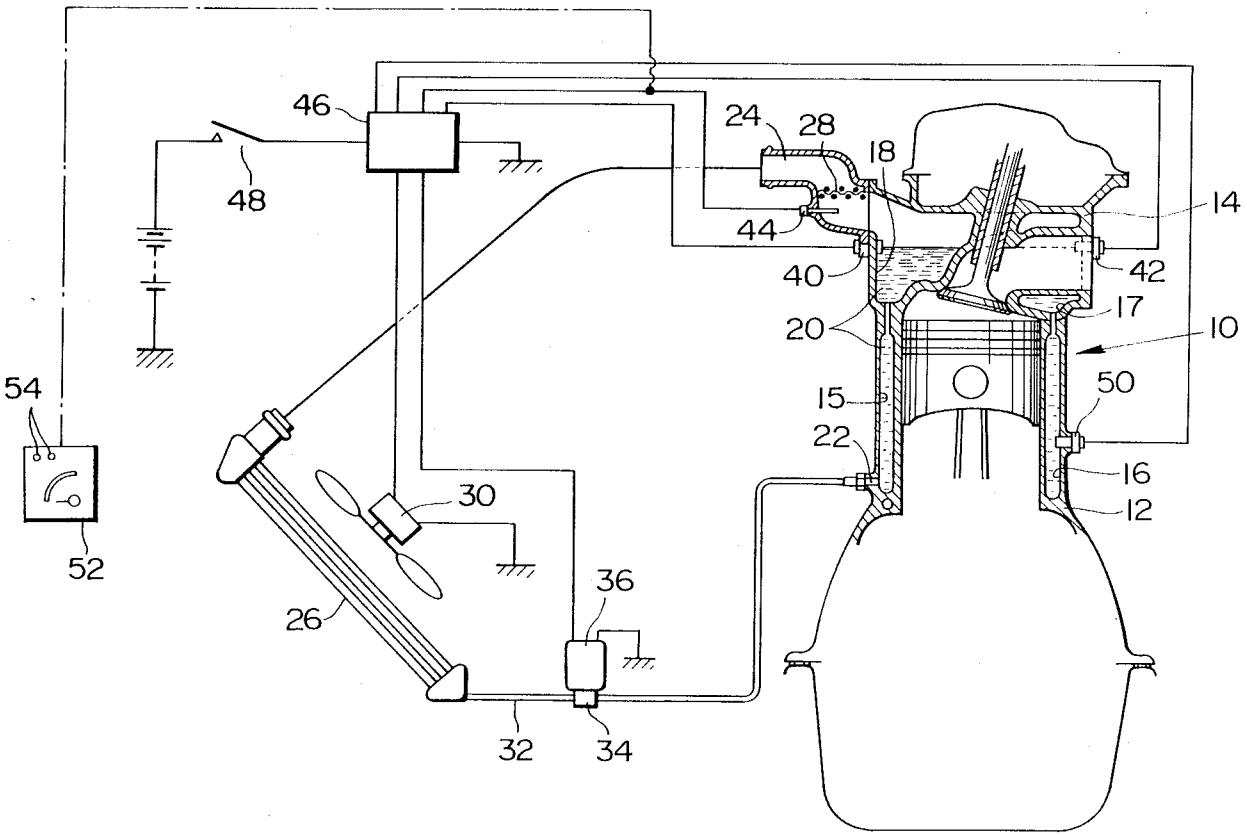
FIG. 1 is a schematic diagram of an engine system including an embodiment of the invention.

In FIG. 1 an embodiment of the present invention is shown. In this arrangement an internal combustion engine 10 includes a cylinder block 12 on which a cylinder head 14 is detachably secured. The cylinder head and cylinder block include suitable cavities 15–18 which define a coolant jacket 20. In this embodiment the coolant is introduced into the coolant jacket 20 through a port 22 formed in the cylinder block 12 and so as to communicate with a lower level of the coolant jacket 20. Fluidly communicating with a vapor discharge port 24 of the cylinder head 12 is a radiator 26. Disposed in the vapor discharge port 24 is a separator 28 which in this embodiment takes the form of a mesh screen. The separator 28 serves to separate the droplet of liquid and/or foam which tend to be produced by the boiling action, from the vapor per se and minimize unecessary liquid loss from the coolant jacket.

Located suitably adjacent the radiator 26 is a electrically driven fan 30. Disposed in a coolant return conduit 32 is a return pump 34. In this embodiment, the pump is driven by an electric motor 36.

In order to control the level of coolant in the coolant jacket, two level sensors 40, 42 are disposed as shown. Located above the level sensor 40 is a temperature sensor 44 (or alternatively a pressure sensor). The outputs of the level sensors 40, 42 and the temperature sensor 44 are fed to a control circuit 46 or modulator which is suitably connected with a source of EMF upon closure of a switch 46. This switch of course may advantageously be arranged to be simultaneously closed with the ignition switch of the engine (not shown).

A "low" level sensor 50 is disposed in the cylinder block 12 and exposed to the coolant jacket 20 at a predetermined "low" level. The purpose of this sensor will become clear hereinafter.

The level sensors 40, 42 are preferably arranged to produce a signal upon being immersed in coolant. This provides the safeguard should one or more of the sensors (it being noted that the invention is not limited to use of only two sensors) malfunction, the absence of a signal therefrom will cause the energization of the pump motor 36 which overfills the coolant jacket. This guards against an undetected lack of coolant. In the illustrated arrangement the level sensors 40, 42 are arranged on either side of the cylinder head 14 so that should the attitude of the coolant surface change under the influence of cenrifugal force (produced when traversing a curve or the like) or due to the vehicle running on a slanted surface, at least one of the sensors 40, 42 will be immersed in coolant and thus issue a signal. Thus, until both (or all) of the sensors indicate the level having fallen below same, the pump motor 37 is not energized.

The control circuit is arranged to control the operation of the fan 30 in a manner that upon a temperature above a preselected level prevailing in the cylinder head 14 the fan motor is energized to induce a cooling flow of air to pass over the radiator and induce more rapid condensation of the vapor being introduced thereinto. For example, if a temperature of 119 degrees C. is sensed, circuit 46 energizes the fan 30 until the temperature falls to 100 degrees C. (by way of example). Alternatively, if a pressure sensor is used, upon a pressure of 0.9 $Kg/cm^2$ (corresponding to 119 degrees C.) being sensed as prevailing in the cylinder head the fan be energized until the pressure has fallen to a suitable level.

In this embodiment the control circuit 46 is arranged to, in the event that the temperature in the cylinder head 14 is below a given value indicating a "cold engine", reverse the operation of the pump to pump coolant out of the coolant jacket until the "low" level sensor 50 ceases to output a signal (viz., indicates the coolant level being just below the sensor. This of course markedly reduces the amount of heat which may be removed from the cylinder liners and cylinder head which very rapidly warm up under such conditions. Upon the temperature in the cylinder head 14 being sensed as having risen to a level where normal engine operation can be carried out, the pump motor 36 is energized in a manner to fill the coolant jacket until at least one of the "upper level" sensors 40, 42 is just immersed.

In order to solve the "dry-out" problem it is preferable to arrange the "upper level" sensors 40, 42 to detect a predetermined level which is above that of the structure defining the combustion chamber and associated valving and ports. With this arrangement, other than during warm-up, the cylinder head 14 is securely filled with sufficient coolant to ensure that all of the heated surfaces remain constantly immersed and wetted thereby.

It will be noted that with the present invention the flow rate of coolant is extremely low as compared with the water circulation type. This is due to the fact that the latent heat of evaporation of water is 539 Kcal/Kg. whereby, in order to remove 4000 Kcal of heat from the engine, only 1.23 Kg/min (4000/60/539) is required. Moreover, with the circulation type cooling arrangement, the temperature distribution within the engine is approximately 30 degrees while with the invention less than 6 degrees. Thus, due to the almost uniform temperature of the engine, knocking due to "hot spot" formation is prevented.

It is also possible to provide an engine temperature meter on the instrument panel of the vehicle for indicating the temperature of the engine. As a precautionary measure warning lights 54 can be incorporated in the meter for altering the driver to a possible engine overheat condition.

It will be understood that in accordance with the present invention, if a plurality of "upper level" sensors are used (for example 3), irrespective of the change in attitude of the coolant surface, as long as an adequate amount of coolant is present in the coolant jacket the pump will not be undesirably energized to pump excessive coolant into the cylinder block. Conversely, and more importantly, the arrangement prevents "hot spot" inducing low levels thus securing against any "dry out" phenomenon.

What is claimed is:

1. In an internal combustion engine;

means defining a coolant jacket into which coolant is introduced in liquid form and discharged in gaseous form;

a pump for recirculating liquid coolant from a radiator into which gaseous coolant from said coolant jacket is introduced and condensed to a liquid form, to said coolant jacket;

a first level sensor disposed in said coolant jacket for detecting the presence of liquid coolant at a predetermined level therein;

a control circuit responsive to said level sensor for energizing said pump when said sensor indicates said level is below said predetermined one;

a low level sensor for sensing the presence of liquid coolant at a predetermined low level; and a temperature sensor disposed in said coolant jacket for sensing the temperature prevailing in said coolant jacket at a level above said predetermined one, said control circuit being responsive to said temperature sensor for energizing said pump in a manner to pump liquid coolant from said coolant jacket into said radiator until said low level sensor detects the absence of liquid coolant and maintains the level of liquid coolant at this level until said temperature sensor indicates the temperature of said engine has risen to a predetermined value.

2. An internal combustion engine as claimed in claim 1, further comprising a separator disposed between said coolant jacket and said radiator for separating liquid coolant from gaseous coolant and causing the liquid coolant to return to said coolant jacket, said separator being located a level above said predetermined one.

3. An internal combustion engine as claimed in claim 1, further comprising a pressure sensor disposed in said coolant jacket for sensing the pressure prevailing in said coolant jacket, said control circuit being operatively connected with said pressure sensor and arranged to control the operation of a fan arranged to induce a flow of cooling air over said radiator in response to the pressure indicated by said pressure sensor.

4. An internal combustion engine as claimed in claim 1, further comprising a switch for connecting said control circuit with a source of electric power, said switch being arranged to be closed and supply power to said control circuit upon said engine being started.

5. An internal combustion engine as claimed in claim 1, wherein said engine includes a cylinder block and a cylinder head, wherein said coolant jacket is defined by a cavity formed in said cylinder block and a cavity formed in said cylinder head, wherein said level sensors are disposed in said cylinder head in a manner to sense the level of liquid coolant in the cavity formed therein and said low level sensor is disposed in said cylinder block to sense the level of liquid coolant in the cavity formed therein and wherein said pump is arranged to fluidly communicate with said cavity in said cylinder block at a level equal to or lower than that at which said low level sensor is disposed.

6. In an internal combustion engine;

means defining a coolant jacket into which coolant is introduced in liquid form and discharged in gaseous form;

a pump for recirculating liquid coolant from a radiator into which gaseous coolant from said coolant jacket is introduced and condensed to a liquid form, to said coolant jacket;

a first level sensor disposed in said coolant jacket for detecting the presence of liquid coolant at a predetermined level therein;

a second level sensor, said first and second level sensors being arranged in different locations within said coolant jacket and in a manner that when said coolant jacket is filled to said predetermined level and the attitude of the coolant surface changes due to a change in orientation of the engine, at least one of said sensors remains immersed in said coolant;

a control circuit responsive to said level sensors for energizing said pump when both of said sensors indicate said level is below said predetermined level;

a temperature sensor disposed in said coolant jacket for sensing the temperature prevailing therein;

a fan for inducing a flow of cooling air to pass over said radiator, said fan being operatively connected with said control circuit and controlled in response to the temperature sensed by said temperature sensor.

* * * * *